US008539792B2

(12) United States Patent
Barnes et al.

(10) Patent No.: US 8,539,792 B2
(45) Date of Patent: Sep. 24, 2013

(54) RELIGIOUS JEWELRY ARTICLES

(75) Inventors: Thomas D. Barnes, Old Hickory, TN (US); Joseph D. Guerriero, Monroe, LA (US); Morris E. Cohen, Brooklyn, NY (US)

(73) Assignee: Tri-State Trinity LLC, Monroe, LA (US)

( * ) Notice: Subject to any disclaimer, the term of this patent is extended or adjusted under 35 U.S.C. 154(b) by 0 days.

(21) Appl. No.: 12/641,827

(22) Filed: Dec. 18, 2009

(65) Prior Publication Data

US 2011/0146346 A1 Jun. 23, 2011

(51) Int. Cl.
*A44C 15/00* (2006.01)

(52) U.S. Cl.
USPC ..... 63/23; 63/1.11; 63/1.13; 63/21; 362/104

(58) Field of Classification Search
USPC ..... 63/21, 23, 33, 1.11, 1.13; D11/79, D11/121, 130, 122; 362/104
See application file for complete search history.

(56) References Cited

U.S. PATENT DOCUMENTS 2,244,101 A * 6/1941 Dittman et al. ..... 362/566
2,506,800 A * 5/1950 Maclennan ..... 250/464.1
D178,329 S * 7/1956 Weisberg ..... D26/94
2,759,096 A * 8/1956 Caissie ..... 362/235
4,237,525 A * 12/1980 Deter ..... 362/104
D286,386 S * 10/1986 Orr ..... D11/86
4,785,642 A * 11/1988 Chin et al. ..... 63/1.13
4,866,863 A * 9/1989 Scarcello et al. ..... 40/124.5
5,201,578 A * 4/1993 Westmoland ..... 362/104
5,582,883 A * 12/1996 Keshishian ..... 428/3
5,653,524 A * 8/1997 Gray ..... 362/104
D388,733 S * 1/1998 Campbell ..... D11/81
D396,930 S * 8/1998 Snipes, Jr. ..... D99/25
D400,467 S * 11/1998 Campbell ..... D11/81
D431,491 S * 10/2000 Sprawls et al. ..... D11/81
D508,580 S * 8/2005 Norris et al. ..... D26/67
7,000,428 B2 * 2/2006 Kamara et al. ..... 63/3
7,001,056 B2 * 2/2006 Clegg ..... 362/571
D580,813 S * 11/2008 Trimble ..... D11/81
2007/0064412 A1 * 3/2007 Radley-Smith ..... 362/104
2007/0209391 A1 * 9/2007 Tamir et al. ..... 63/40
2009/0044566 A1 * 2/2009 Underdown et al. ..... 63/3
2009/0217702 A1 * 9/2009 Nagornova ..... 63/1.13

* cited by examiner

*Primary Examiner* — Victor Batson
*Assistant Examiner* — Emily Morgan
(74) *Attorney, Agent, or Firm* — Goldberg Cohen LLP

(57) ABSTRACT

New forms of religious jewelry. Jewelry articles are provided representing the tomb of Jesus, to depict and/or symbolize the event of the Resurrection for Christian religious adherents.

6 Claims, 2 Drawing Sheets

RELIGIOUS JEWELRY ARTICLES

FIELD OF THE INVENTION

The present invention relates to the field of religious articles, namely, articles of jewelry for religious adherents of Christian denominations.

BACKGROUND OF THE INVENTION

Religious jewelry is well known in the art, and, in fact, the practice of wearing religious jewelry dates back to antiquity. In Christianity, in particular, jewelry in the shape of a cross is commonly provided for depiction of the crucifixion of Jesus.

SUMMARY OF THE INVENTION

The present invention is directed to new forms of religious jewelry. In particular, jewelry articles are provided in the image and/or structure of the tomb of Jesus, to depict and/or symbolize an important religious event and place for Christian religious adherents.

DETAILED DESCRIPTION OF THE INVENTION AND THE PREFERRED EMBODIMENTS

In accordance with the present invention, a religious article is provided in the structure and/or image of a tomb or cave to serve as an article of jewelry depicting and/or symbolizing an event and/or place in religious history.

In the preferred embodiments, articles are provided for use by Christian religious adherents.

In the further preferred embodiments, the invention is an article of jewelry provided for use by Christians or others to depict and/or symbolize the Resurrection in Christian theology, namely, the resurrection of Jesus after the crucifixion.

In further preferred embodiments, a method is disclosed of commemorating or symbolizing a religious event by providing to customers and/or users, and/or by using, an article of jewelry which is meant to depict or symbolize the resurrection of Jesus. In preferred embodiments, the article used resembles, depicts, or symbolizes a tomb or cave, specifically, the tomb of Jesus.

Figure 1:
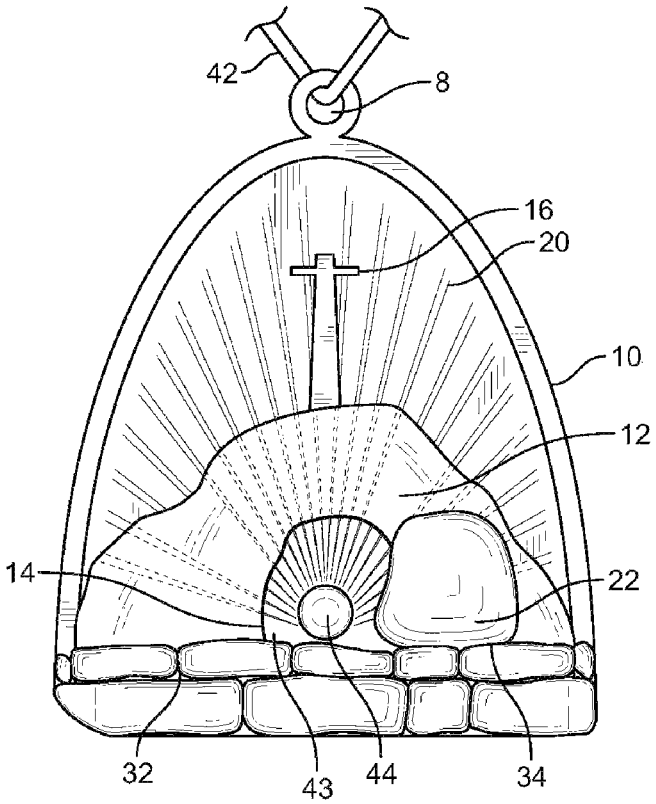
FIG. 1 is a plan view of the front of a first embodiment of the present invention, depicting an article for use as Christian jewelry.

As shown in FIG. 1, for example, an article of jewelry 10 is provided depicting a tomb or cave 12 having an entrance 14. In one embodiment, the tomb has a cross 16 above it. Alternatively or additionally, cross 16 can be placed inside entrance 14, on the back of the religious article, or otherwise on or in association with it. Likewise, any other suitable symbol or text relating to Christianity or the resurrection of Jesus can be placed on or in association with the religious article.

In alternate or additional embodiments, the religious article can be provided with the image of rays of light 20, whether above and/or around tomb 12 and/or within entrance 14, or otherwise.

In yet further alternate or additional embodiments, the cave 12 can be provided with one or more stones 22 to cover or seal entrance 12. Stone 22 can be fixed in place or movable, as discussed below. In addition, stone 22 can be provided in any desired position, whether to the right and/or left of the entrance 12, or otherwise.

In those embodiments where article of jewelry 10 is intended for use as part of a necklace 42, article 10 can be further provided with an eye 8 for threading a chain therethrough. Alternatively or additional, any other jewelry features currently known or later developed in the art can be used in conjunction with the invention, whether a clasp for a bracelet, a pin for a pendant, or otherwise.

As such, article 10 is used as a religious article and symbol in a manner analogous to use of a cross to depict an event in the life of Jesus. However, while a cross depicts a tragic event in Christian theology, namely, persecution, killing, and death, the use of the tomb or cave is intended to depict a joyous occasion, namely, resurrection, rebirth, and life.

In additional or alternative embodiments, the two-dimensional image or three-dimensional representation of a person can be placed within or outside the tomb or cave, to represent the resurrection of Jesus.

In further embodiments, any of the features, structures, or images of the invention described herein can be placed on the front side of the religious article and/or on the back of it.

In various embodiments, the invention can be depicted in any of numerous shapes to represent a tomb, cave, or rock or a rock face such as that of a mountain. FIG. 1 is one such shape merely provided for illustration purposes, although it will be understood that the figures are not intended as a limitation on the scope of the invention.

The tomb or cave 12 can be illustrated flat or in three dimensional form. For example, in one embodiment, the tomb 12 can be illustrated on a flat article of jewelry, whether by painting, carving, or otherwise. In an alternative or additional embodiment, the tomb 12 can be provided as a three dimensional object shaped like a rock or rock face such as the outside of a mountain. Preferably, the mountain further includes a hollowed out portion representing a cave.

In one embodiment of the invention, the tomb is provided with one or more stones 22 adjacent or proximate to the cave's entrance. That stone or stones can be to the right and/or left of the cave entrance, or otherwise in any position or location with respect to the cave entrance. If desired, stone 22 can be covering the cave entrance in whole or in part.

In one such embodiment, the stone or stones are fixed in place.

In additional or alternative embodiments, one or more stones 22 are movable in front of and away from the cave entrance. Preferably, the stone is designed to move, slide or roll away from the tomb entrance 14 allowing one to view the tomb entrance and the tomb's interior 43. Likewise, the stone can move back in front of the tomb entrance to conceal the interior 43 of the tomb.

In one such embodiment, one or more stones 22 are hinged allowing them to be folded back to the right and/or left to reveal or conceal the interior of the tomb.

In a further embodiment, a track is placed along a portion of the article and includes a rail or bar 32 which extends into a groove or channel 34 in the stone 22. Stone 22 can slide along that track, as well known, for example, with respect to sliding doors. Or, stone 22 can be configured to roll or pivot, allowing one to open or close the tomb entrance. For example, a small ball bearing can be located within a channel or recess in stone 22, the ball bearing having a short rod extending therefrom which affixes the ball bearing to the article to allow movement of the stone in front of and away from the cave entrance. The track, ball bearing or other mechanism for movement of the stone wise can be affixed to the ground in front of the cave, to the front surface of the cave (whether the cave's outer entrance or otherwise), or inside the cave as desired. Likewise, the track or ball bearing can extend into a channel or recess on the bottom or top of the stone, the back or front of the stone, or otherwise, allowing the stone to slide, pivot, or roll to partially or totally block and partially or totally reveal the view of the interior of the cave. If desired, the stone or stone can be configured to move away from the cave entrance such that it remains outside of the cave, or can be configured to move into the cave entrance and cave itself.

Figure 2:
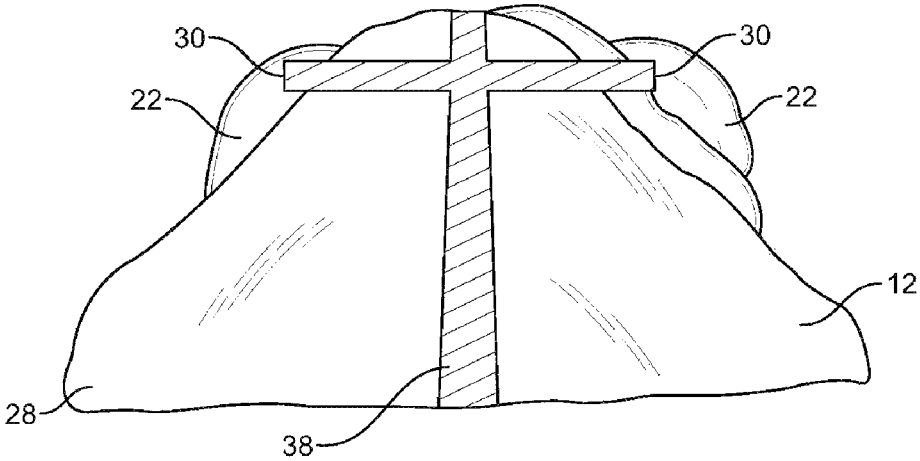
FIG. 2 is a plan view of the back of an additional embodiment of the present invention.

In a further alternate or additional embodiment, the stones move or fold back to secure to the arms 30 of a cross 38 on the back of the jewelry article as shown in FIG. 2. In this manner, one side of the article shows the open tomb entrance 14, and the opposite side 28 shows a cross 30 in the face of a mountain, with the arms of the cross being used to hold the stones in place, leaving the tomb entrance open.

In any of these embodiments, the article can be a locket, with the movable stone acting as the door of the locket. The cave entrance can have an image placed therein or depicted in the cave, if desired. Additionally or alternatively, the cave can be a recess with room available for placement of a photograph or other object within the cave. Further alternatively or additionally, the tomb itself can be placed within a locket, such that either the tomb face and cave entrance, or the interior of the cave itself, is visible when the locket door is opened. For example, the exterior of the locket can be in the shape of a mountain face, which opens to reveal the interior of the tomb. Or, a traditional locket exterior can be provided which opens to reveal the exterior of the mountain with a cave entrance, or which opens to reveal the interior of the tomb.

In yet further alternative or additional embodiments of the invention, the figure of Jesus can be placed on one or more crosses on or associated with the article. For example, a human figure can be provided on a cross on the back of the article. In this manner, a before and after image is provided, the back of the jewelry being the before image of the crucifixion, and the front of the jewelry being the after image of the resurrection.

In any of the embodiments of the invention, the jewelry can be partly or wholly made from and/or provided with precious or semi-precious gemstones, or any other stones. These include, but are not limited to, diamonds, emeralds, rubies, sapphires, pearls, aventurine, agate, alexandrite, amethysts, aquamarine, carnelian, citrine, garnets, jade, jasper, malachite, lapis lazuli, moonstones, onyx, opals, peridots, quartz, sodalite, sunstone, tanzanite, tiger's eye, topaz, tourmaline, amber, copal, coral, jet, abalone, and/or any other gems, and/or any combination thereof. The article can be made from or carved from a single stone, or made from one or more stones, whether the same stone or a combination of different stones. Likewise, if desired, the article can be made from or include particular birthstones (i.e. gems corresponding to the month one of one's birth), or any other stones.

Likewise, in any of these embodiments, the jewelry can be partly or wholly made from and/or provided with metals, whether gold, silver, copper, platinum, palladium, rhodium, brass, bronze, pewter, steel, titanium, or any metals, whether precious metals, pure metals, alloys, or otherwise, and/or any combination thereof. Similarly, the article can be made of any combination of metals and stones desired, or any other desired combination of materials.

In further additionally or alternative embodiments, the jewelry article is partially or totally made of a transparent material, such as glass or a suitable crystalline material, such that the interior of the tomb is visible to the user. Further additionally or alternatively, a translucent material can be used in whole or in part.

Yet, further additionally or alternatively, a light can be placed on or in association with the tomb. This embodiment, using a light, can be used in conjunction with any of the embodiments of the invention, whether an embodiment which is transparent or translucent in part, or otherwise.

As examples, one or more lights in the form of an LED or small incandescent bulb can be used, the light being provided with a power source such as a small battery or solar cell, so that the light is operable to provide illumination. For example, the light source 44 can be placed within the tomb or cave to illuminate it from within, or can be placed on the top of the mountain, or in front of the cave entrance. A switch can also be provided to allow the user to turn the light on and off, to illuminate the inside and/or outside of the religious article, whether when triggered by the user or when one or more portion of the religious article are moved, whether the stone, the cross or otherwise. For example, in one embodiment, when the stone is moved away from the entrance, the switch is triggered causing the light to illuminate, providing illumination from the interior of the cave and/or illuminating the outside of the religious article.

In one embodiment, the religious symbol is provided on a necklace. In further embodiments, the article is provided on or as part of a bracelet, a pin or pendant, a ring for a finger (or toes), an earring, or any other form of jewelry known in the art. In further embodiments, any other article, ornamentation, method, or technique known in the art of jewelry making can likewise be utilized consistent with the invention.

In further embodiments, as an alternative or addition to the use of the present inventions are religious jewelry, the inventions herein are utilized as a Christmas ornament having any combination of the features described herein.

Additionally, the present description of the embodiments of the inventions is not intended as a limitation; rather, the embodiments can be used in any combination with each other and/or in any combination with any jewelry or Christmas ornament embodiments known or subsequently developed in the art.

Having described this invention with regard to specific embodiments, it is to be understood that the description is not meant as a limitation since further embodiments, modifications and variations may be apparent or may suggest themselves to those skilled in the art. It is intended that the present application cover all such embodiments, modifications and variations.

What is claimed is:

1. A religious article, comprising:

an article of jewelry;

said jewelry being three dimensionally shaped to provide the appearance of at least a portion of a mountain;

said jewelry comprising an entrance to said mountain;

said jewelry comprising an object simulating the appearance of a stone, wherein said object is proximate to said entrance, and wherein said object is moveable away from said entrance to reveal the interior of said mountain;

wherein said article comprises a light therein for providing illumination;

and wherein movement of said object away from said entrance causes said light to illuminate within said article and through said entrance.

2. A religious article as claimed in claim 1, wherein said entrance is a recess in said jewelry.

3. A religious article as claimed in claim 1, wherein said religious article comprises an interior and said light illuminates said interior of said religious article.

4. A religious article as claimed in claim 1, wherein at least a portion of said religious article comprises a material which is transparent or translucent, and wherein said illumination provided by said light is visible through said material.

5. A religious article as claimed in claim 1, wherein said article comprises a necklace.

6. A religious article as claimed in claim 1, wherein said jewelry comprises the image of a cross.

* * * * *